343-700 MS AU 256 EX
1/31/78 OR 4,071,846

United States Patent [19]

Oltman, Jr.

[11] 4,071,846

[45] Jan. 31, 1978

[54] WIRED MICROSTRIP LINEAR ARRAY OF DIPOLES

[75] Inventor: Henry G. Oltman, Jr., Woodland Hills, Calif.

[73] Assignee: Hughes Aircraft Company, Culver City, Calif.

[21] Appl. No.: 695,359

[22] Filed: June 14, 1976

[51] Int. Cl.[2] ..... H01Q 9/38

[52] U.S. Cl. ..... 343/700 MS; 343/846

[58] Field of Search ..... 343/846, 700 MS, 854

[56] References Cited

U.S. PATENT DOCUMENTS

| | | | |
|---|---|---|---|
| 3,987,455 | 10/1976 | Olyphant | 343/700 MS |
| 3,995,277 | 11/1976 | Olyphant | 343/700 MS |

*Primary Examiner*—Archie R. Borchelt
*Assistant Examiner*—David K. Moore
*Attorney, Agent, or Firm*—Robert H. Himes; W. H. MacAllister

[57] ABSTRACT

A microstrip linear array of dipoles is disclosed wherein the dipoles are phased in alternate directions thereby enabling them to be spaced at approximately one-half wavelength intervals along or across a microstrip line instead of the typical one wavelength interval. An additional embodiment includes two linear arrays of oppositely polarized dipoles fed by tributary lines located at either side of a main microstrip line. Alternatively, first and second linear arrays of dipoles are disposed on opposite sides of a circuit board and the dipoles fed by microstrip line that evolves into a balanced two wire line. The ground plane on one side of the circuit board is made to gradually taper to a width equal to the microstrip line on the opposite side at which point the latter is called a two-wire line. Dipoles attached to each terminal of the two-wire line are offset in opposite directions in order to properly phase the currents on each dipole so that the currents flow in the same direction and the pair of dipoles radiates incident power with an omnidirectional pattern similar to a conventional dipole antenna.

8 Claims, 8 Drawing Figures

Fig. 1.
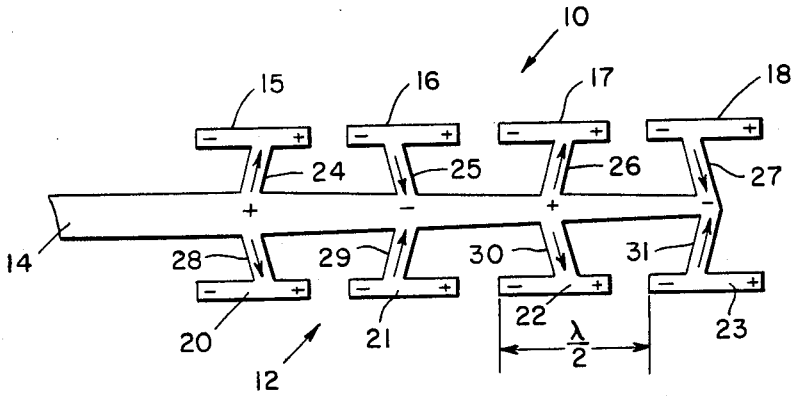
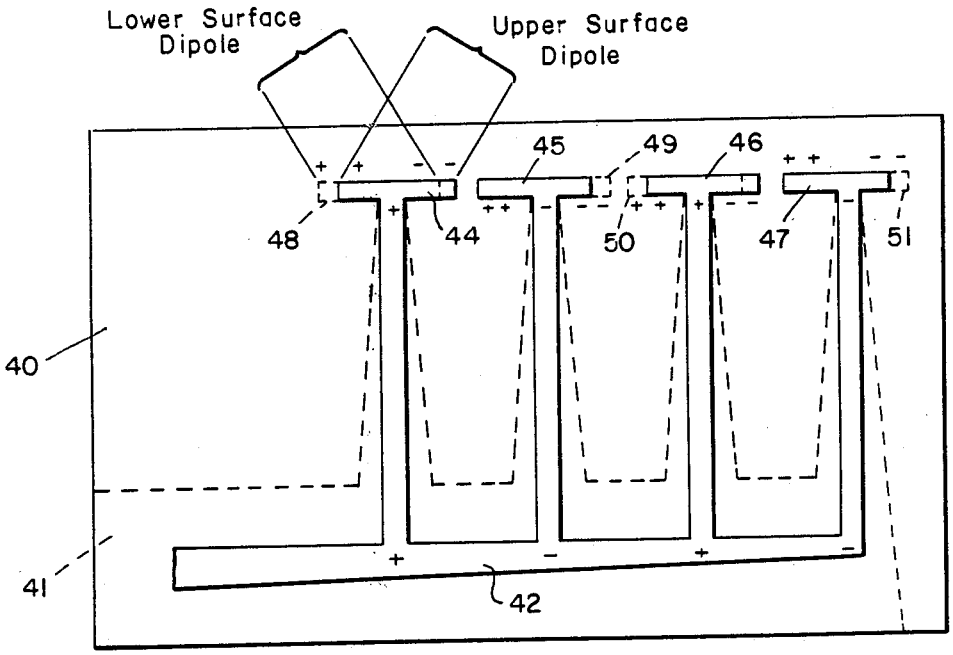
Fig. 2.

Fig. 3a.
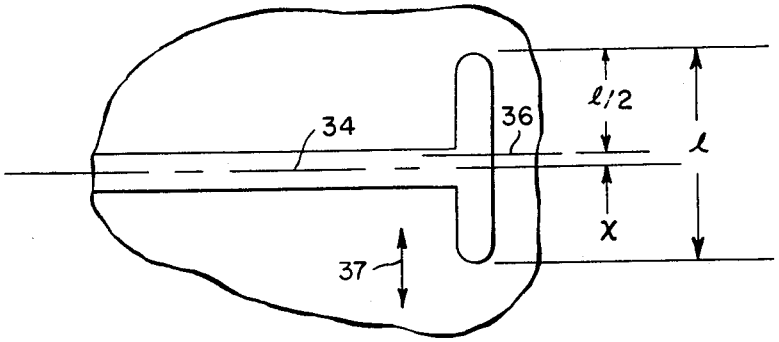
Fig. 3b.
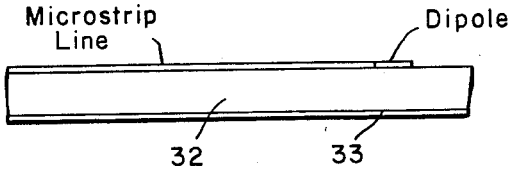
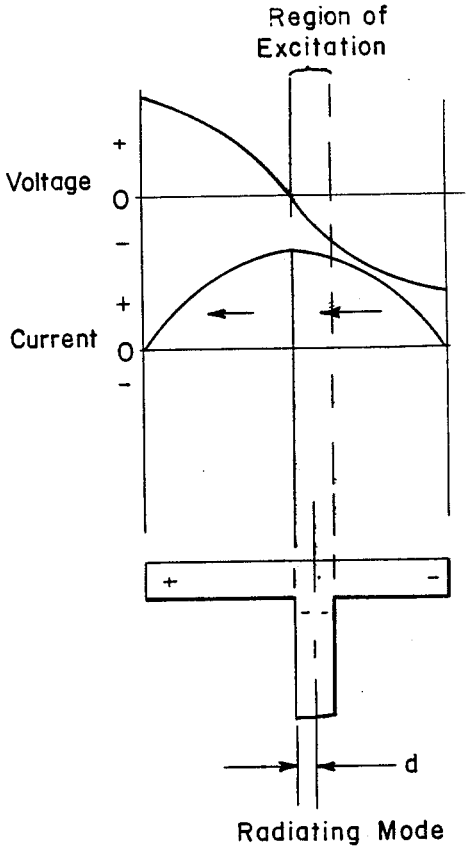
Fig. 4a.
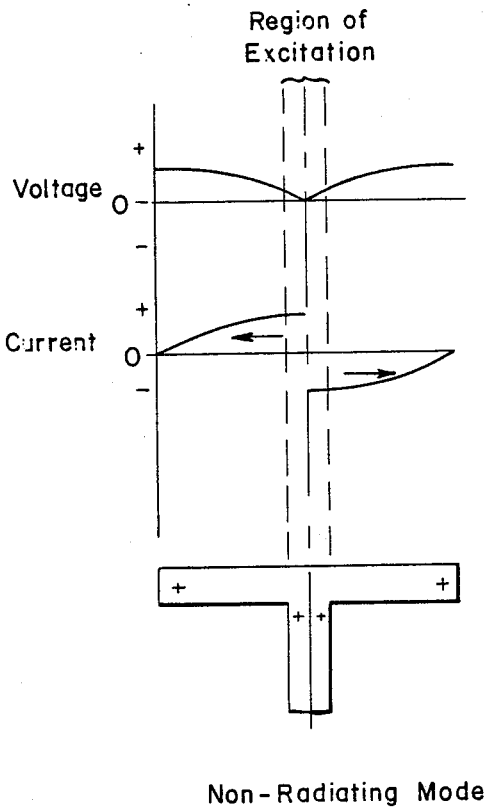
Fig. 4b.

WIRED MICROSTRIP LINEAR ARRAY OF DIPOLES

BACKGROUND OF THE INVENTION

A microstrip phased array antenna has been disclosed wherein the dipoles are required to be broad, squarish conductors in order to match the microstrip line that they are attached to. The polarization of these dipoles is in-line with the length of the feed line and perpendicular to the polarization that would be radiated by the dipoles in the present case. The coupling in this antenna is determined by the relative widths of the dipoles, the microstrip line width, and the operating wavelength. The antenna functions as an antenna because of the large mismatch at the dipole-microstrip junction, which in effect traps the signal on the dipole where it must radiate.

SUMMARY OF THE INVENTION

In accordance with the invention, the respective dipoles of a linear array of dipoles spaced approximately one-half wavelength apart are "hard-wired" to microstrip feed lines at intervals of approximately one-half wavelength. The successive dipole centers are alternately offset from the centerline of the microstrip feed lines by an amount "X". The magnitude of X is important in the operation of the antenna in that it determines the degree of coupling between the microstrip line and the radiating mode of the dipole. The individual dipoles radiate their signal polarized along the dipole length which is perpendicular to the microstrip feed line. Alternating the offset causes the phase of successive dipoles to alternate whereby they can be spaced at approximately half wavelength intervals for most efficient operation.

BREIF DESCRIPTION OF THE DRAWINGS

FIG. 1 illustrates two parallel corresponding linear arrays of dipole elements fed from opposite sides of a microstrip line;

FIG. 2 illustrates two linear arrays of offset wired dipoles disposed on opposite sides of a circuit board to obtain an antenna radiation pattern that is different than that of a single linear array;

Figure 5:
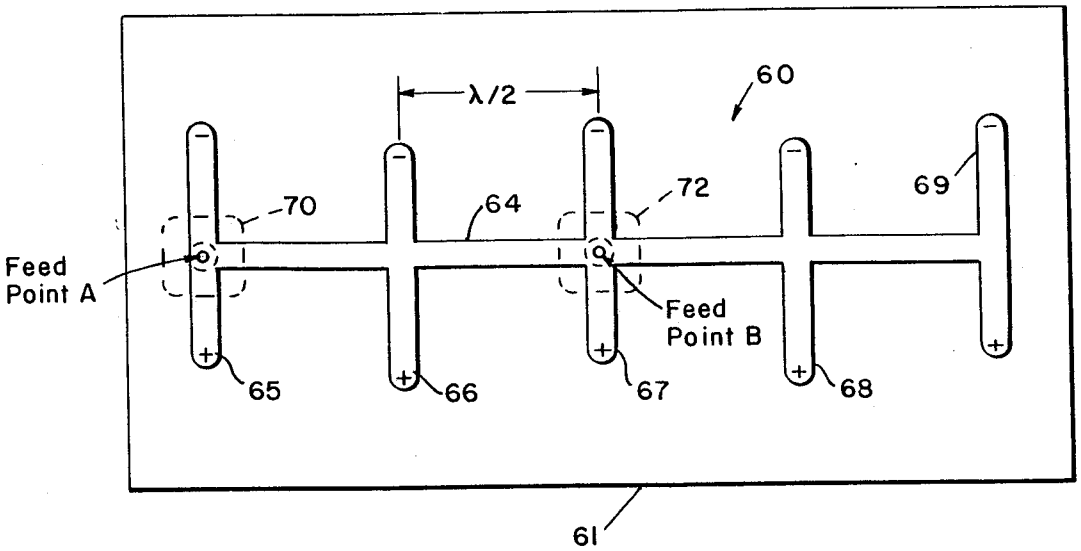
Figure 6:
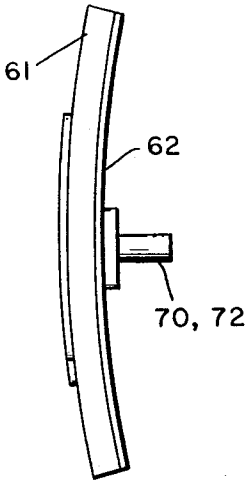

FIGS. 3*a* and 3*b* shows top and side views of a wired microstrip dipole antenna element;

FIGS. 4*a* and 4*b* illustrates current and voltage waveforms for the two possible excitation modes capable of existing on a dipole; and FIGS. 5 and 6 illustrate plan and end views, respectively, of a microstrip linear array wherein the microstrip dipoles are disposed orthogonal to a main microstrip feed line at one-half wavelength intervals.

DESCRIPTION

Referring to FIG. 1 there is illustrated two parallel linear arrays 10, 12 of four microstrip dipole elements each of which are fed from opposite sides of a main microstrip line 14. The linear array 10 includes microstrip dipoles 15, 16, 17 and 18 spaced at approximately half transmission line wavelength intervals and the linear array 12 includes microstrip dipoles 20, 21, 22 and 23 disposed opposite dipoles 15, 16, 17 and 18, respectively. Tributary microstrip lines 24, 25, 26, 27 emanate from the top side of the main microstrip line 14, as viewed in the drawing, at approximately half transmission line wavelength intervals therealong. Similarly, tributary microstrip lines 28, 29, 30, 31 emanate from the bottom side of the main microstrip line 14, as viewed in the drawing, directly opposite the tributary microstrip lines 24, 25, 26, 27, respectively. Tributary microstrip lines 24, 26, 28, 30 are connected to the right of the middle of dipoles 15, 17, 20, 22, respectively, as viewed in the drawing, and tributary microstrip lines 25, 27, 29, 31 are connected to the left of the middle of dipoles 16, 18, 21, 23 respectively, as viewed in the drawing. The microstrip lines and dipoles are disposed upon a suitable dielectric substrate having a metal ground plane on the other side thereof.

FIG. 3(*a*) shows a top view and FIG. 3(*b*) a side view of a tributory microstrip line 24–30 or 31 connecting to a respective dipole. Both the microstrip line and the dipole can be simultaneously fabricated by contemporary photoetching techniques using double-clad circuit board material 32 as shown in FIG. 3(*b*). The side of circuit board material that is not photoetched provides a ground plane 33. FIG. 3(*a*) illustrates the offset of the centerline 34 of a tributary microstrip line from the centerline 36 of one of the dipoles of FIG. 1 by an amount, "X". The magnitude of X is important in the operation of the antenna as it determines the degree of coupling between the tributary microstrip line 24–30 or 31 and the respective dipole 15, 16, 17, 18, 20, 21 22 or 23. The dipole radiates its signal polarized along the dipole length which is orthogonal to the length of the tributary microstrip line as illustrated by the vector 37.

In exciting a dipole element, there are two voltage and current modes that can exist on the dipole. These modes are illustrated in FIG. 4(*a*) and FIG. 4(*b*) of the drawings. FIG. 4(*a*) illustrates the radiating mode and FIG. 4(*b*) illustrates the non-radiating mode. If the dipole is attached to the microstrip line with the centerline thereof coinciding as in FIG. 4(*b*), only the non-radiating mode currents and voltages occur. This is due to the symmetry in the region of excitation where the same voltage polarity exists on both sides of the dipole centerline.

If the centerline of the dipole is offset from the centerline of the microstrip line as shown in FIG. 4(*a*), however, the exciting voltage on the microstrip line is predominantly on one side of the dipole and therefore couples loosely to the asymmetrical (voltage) radiating mode. The degree of coupling depends on the magnitude of offset relative to the dipole length. If the dipole is excited by a voltage, the frequency of which corresponds to a resonant length of the dipole, the asymmetric currents will build up to a large value in a manner determined by the coupling and, hence, the offset. There exists an optimum offset magnitude that will, except for relatively small resistive losses, cause all of the incident power from the microstrip line to be accepted by the dipole and to be completely radiated. For offsets smaller or larger than this optimum offset, part of the incident power is reflected down the line in a manner similar to that which would occur if the circuit were symmetric. The time required for the buildup of currents is related to the "Q" of the resonant dipole in a manner completely analogous to other types of resonant circuits.

The offset can be on either side of the microstrip line. The direction of the offset determines the relative polarity of the dipole voltage relative to the microstrip voltage. Thus, by alternating the offset as in the antenna of FIG. 1 the polarity of successive dipoles can be made to alternate thereby enabling the dipoles 15–18 and 20–23 to be spaced at half wavelength intervals along the main microstrip line 14 instead of at only one wavelength intervals. Also, the dipoles 15–18 and 20–23 can be fed from opposite sides of the main microstrip line 14 by selecting the desired offset direction and the spacing therebetween.

Referring to FIG. 2 there is shown another embodiment of the present invention wherein dipole arrays are fabricated on opposite sides of a circuit board 40. In particular, a conductive ground plane 41 on the underside of the circuit board 40, as shown in the drawing, is made to gradually taper at one-half wavelength intervals to a width equal to that of microstrip line 42 of the opposite side of the circuit board 40 at which point the latter becomes a two-wire line. Dipoles 44, 45, 46, 47 are connected to four arms of the microstrip line 42 located at one-half wavelength intervals and are alternately offset therefrom in opposite directions. Further, dipoles 48, 49, 50, 51 are disposed on the underside of circuit board 41 as shown in the drawing opposite the dipoles 44, 45, 46, 47, respectively, and are connected to corresponding branches of the ground plane 41 and offset therefrom in directions opposite from the offset of the corresponding dipoles 44, 45, 46, 47, respectively. In operation, since currents on the two-wire line are 180 degrees out of phase, the currents on corresponding dipoles 44, 48; 45, 49; 46, 50; and 47, 51 are in phase, i.e., are in the same direction whereby each dipole pair radiates the incident power with an omnidirectional pattern similar to a conventional dipole antenna.

Referring to FIGS. 5 and 6 there is shown plan and end views, respectively, of a microstrip array 60 of dipoles adapted to radiate in the broadside mode. In particular, the linear array 60 includes a longitudinal circuit board 61 that is either planar or possesses a slight curve normal to the longitudinal axis and a ground plane 62 disposed on the concave side thereof. Further, a microstrip feed line 64 is disposed along the longitudinal axis of circuit board 61 on the convex side thereof with dipoles 65, 66, 67, 68, 69 disposed orthogonal thereto at one-half wavelength intervals therealong. The dipoles 65, 67, 69 are offset from the microstrip feed line 64 in one direction and the intervening dipoles 66, 68 offset in the opposite direction. A feed point "A" may be located at one extremity of the array 60 such as, for example, at the junction of dipole 65 and microstrip feed line 64. Alternatively, a feed point "B" at the center of the array may be located at the junction of dipole 67 and microstrip feed line 64. Feed points A or B are implemented by means of coaxial connectors 70, 72 disposed on the concave side of circuit board 61 with the respective center conductors thereof extending therethrough to the feed points A or B. Only one of the feed points is used at any one time.

In operation, the array 61 may be fed from feed points A or B when using signal corresponding to 180 degrees phase difference between successive dipoles 65–69. In this case, the polarity of the exciting voltage will alternate between plus and minus along the microwave transmission line 64, as shown. In that the offset of the dipoles 65–69 is also alternating, i.e. the dipoles 65, 67, 69 with the plus polarity, as shown in the drawing, are offset above the microstrip line 64 and the dipoles 66, 68 are offset below the microstrip line 64, all of the dipoles 65–69 have the same polarity and hence radiate signals of the same electrical phase. Since the dipoles 65–69 are spaced at one-half wavelength intervals, a single narrow broadside beam is formed.

When feed point A is fed with a signal which makes the phase between successive dipoles 65–69 less than 180°, the beam developed by the array 60 will be canted to the left of broadside in a direction parallel to the microstrip line 64. Alternatively, if the signal makes the phase between successive dipoles 65–68 greater than 180°, the beam developed will be canted to the right of broadside. Lastly, if desired, the ground plane 62 can be replaced with a second conductor substantially similar to the microstrip line 64 thus forming a "two-wire" transmission line.

What is claimed is:

1. A wired microstrip linear array of dipole elements for radiating a signal of a predetermined frequency, said linear array of dipoles comprising a dielectric circuit board having a top side and an underside; a conductive ground plane disposed over said underside of said circuit board; a main microstrip line adapted to propagate said signal of said predetermined frequency therealong disposed on the top side of said circuit board; a plurality of microstrip dipole elements disposed at intervals along a line on the top side of said circuit board, each of said microstrip dipole elements having a center; a first set of tributary microstrip lines of equal electrical length connected at one wavelength intervals along said main microstrip line to successive alternate ones of said microstrip dipole elements at points offset in a consistent direction from the respective centers thereof; and a second set of tributary microstrip lines of said equal electrical length connected along said main microstrip line midway between said first set thereof to successive remaining ones of said microstrip dipole elements at points offset in a direction opposite to said consistent direction from the respective centers thereof.

2. The wired microstrip linear array of dipole elements for radiating a signal of a predetermined frequency as defined in claim 1 wherein the respective centers of said microstrip dipole elements always fall within the width of the tributary microstrip line connected thereto.

3. A wired microstrip array of dipole elements for radiating a signal of a predetermined frequency, said array of dipole elements comprising a dielectric circuit board having a top side and an underside; a conductive ground plane disposed over said underside of said circuit board; a main microstrip line adapted to propagate said signal of said predetermined frequency therealong disposed on the top side of said circuit board; first and second pluralities of microstrip dipole elements disposed at intervals along first and second parallel lines on opposite sides of said main microstrip dipole elements having a center; a first set of tributary microstrip lines of equal electrical length connected at one wavelength intervals along said main microstrip line to successive alternate ones of said first and second pluralities of said microstrip dipole elements at points offset in a consistent direction from the respective centers thereof; and a second set of tributary microwave lines of said equal electrical length connected along said main microstrip line midway between each line of said first set thereof to successive remaining ones of said first and second pluralities of microstrip dipole elements at points offset in a direction opposite to said consistent direction from the respective centers thereof.

4. A wired microstrip linear array of dipole elements for radiating a signal of a predetermined frequency, said array of dipole elements comprising a dielectric circuit board having a top side and an underside; a main microstrip line adapted to propagate said signal of said predetermined frequency therealong disposed on the top side of said circuit board; a first plurality of microstrip dipole elements disposed at intervals along a line on the top side of said circuit board, each of said microstrip dipole elements having a center; a first set tributary microstrip lines of equal electrical length connected at one wavelength intervals along said main microstrip line to successive alternate ones of said microstrip dipole elements at points offset in a consistent direction from the respective centers thereof; a second set of tributary microstrip lines of said equal electrical length connected along said main microstrip line midway between said first set thereof to successive remaining ones of said microstrip dipole elements at points offset in a direction opposite to said consistent direction from the respective centers thereof; conductive ground plane disposed on the underside of said circuit board commencing directly under the respective junctions of said first and second sets of tributary microstrip lines with said first plurality of microstrip dipole elements and tapering outwards along and running the full length of said tributary microstrip lines; additional conductive ground plane disposed on the underside of said circuit board along said main microstrip line connecting with said ground plane along said tributary microstrip lines; and a second plurality of microstrip dipole elements corresponding to said first plurality thereof disposed on said underside of said circuit board along said line and connected to the commencement of said ground plane with an offset opposite to that of the respective dipole elements on said top side of said circuit board.

5. A wired microstrip linear array of dipole elements for radiating a signal of a predetermined frequency, said array of dipole elements comprising a circuit board; a microstrip transmission line of predetermined width substantially less than one-half wavelength at said predetermined frequency disposed longitudinally along said circuit board; and a plurality of microstrip dipole elements disposed orthogonally across said microstrip transmission line substantially at one-half wavelength intervals at said predetermined frequency, the junction of adjacent dipoles with said microstrip transmission line being offset in opposite directions from the respective centers thereof by an amount less than one-half of said predetermined width.

6. The wired microstrip linear array of dipole elements as defined in claim 5 wherein said circuit board is curved backwards from said microstrip transmission line.

7. A wired microstrip linear array of dipole elements for radiating a signal of a predetermined frequency, said array of dipole elements comprising a circuit board; a ground plane disposed on one side of said circuit board; a microstrip line of predetermined width substantially less than one-half wavelength at said predetermined frequency disposed along said circuit board on the side opposite from said one side thereof; a plurality of microstrip dipole elements disposed orthogonally across said microstrip line at one-half wavelength intervals at said predetermined frequency, the junction of adjacent dipoles with said microstrip line being offset in opposite directions from the respective centers thereof by an amount less than one-half of said predetermined width; and means coupled to the junction of a dipole with said microwave line for feeding said array.

8. The wired microstrip linear array of dipole elements for radiating a signal of a predetermined frequency as defined in claim 7 wherein said circuit board is curved normal to said microstrip line and away therefrom.

* * * * *